US008144071B2

(12) United States Patent
Thornell-Pers

(10) Patent No.: US 8,144,071 B2
(45) Date of Patent: Mar. 27, 2012

(54) ANTENNA DEVICE AND PORTABLE RADIO COMMUNICATION DEVICE COMPRISING SUCH AN ANTENNA DEVICE

(76) Inventor: Anders Thornell-Pers, Beijing (CN)

( * ) Notice: Subject to any disclaimer, the term of this patent is extended or adjusted under 35 U.S.C. 154(b) by 514 days.

(21) Appl. No.: 12/296,867

(22) PCT Filed: May 18, 2007

(86) PCT No.: PCT/SE2007/000492

§ 371 (c)(1),
(2), (4) Date: Aug. 19, 2009

(87) PCT Pub. No.: WO2007/136330

PCT Pub. Date: Nov. 29, 2007

(65) Prior Publication Data

US 2010/0007574 A1 Jan. 14, 2010

(30) Foreign Application Priority Data

May 19, 2006 (EP) ..... 06445028

(51) Int. Cl.
*H01Q 1/50* (2006.01)
*H01Q 1/38* (2006.01)

(52) U.S. Cl. ..... 343/860; 343/700 MS; 343/876; 343/850

(58) Field of Classification Search ..... 343/860
See application file for complete search history.

(56) References Cited

U.S. PATENT DOCUMENTS

| | | | | |
|---|---|---|---|---|
| 5,754,143 | A * | 5/1998 | Warnagiris et al. | 343/767 |
| 6,329,962 | B2 * | 12/2001 | Ying | 343/895 |
| 6,476,769 | B1 | 11/2002 | Lehtola | |
| 7,071,875 | B2 | 7/2006 | Sugimoto et al. | |
| 7,741,998 | B2 * | 6/2010 | Thornell-Pers | 343/700 MS |
| 2007/0069957 | A1 * | 3/2007 | Ranta | 343/700 MS |

FOREIGN PATENT DOCUMENTS

| | | | |
|---|---|---|---|
| CA | 2467282 | A1 | 11/2004 |
| EP | 1 367 671 | A2 | 12/2003 |
| JP | 04-008517 | | 1/1992 |
| JP | 10190345 | | 7/1998 |
| JP | 2003-179426 | | 6/2003 |
| JP | 2003-347827 | | 12/2003 |
| JP | 2004-129062 | | 4/2004 |
| JP | 2004-172714 | | 6/2004 |
| WO | WO 99/22420 | | 5/1999 |
| WO | WO 01/28038 | A1 | 4/2001 |
| WO | WO 01/29927 | A | 4/2001 |
| WO | WO 02/078123 | A | 10/2002 |
| WO | WO 2005/048403 | A | 5/2005 |

OTHER PUBLICATIONS

Written Opinion and International Search Report from International application No. PCT/SE2007/000492 (published as WO 2007/136330 A2); (the application that the instant national phase claims priority to) dated Sep. 14, 2007, 8 pages.

(Continued)

*Primary Examiner* — Trinh Dinh
(74) *Attorney, Agent, or Firm* — Harness, Dickey & Pierce, P.L.C.

(57) ABSTRACT

A quad-band antenna device (10) for a portable radio communication device comprises two radiating elements (12, 14) of different lengths and two common conductors (18, 20) of different lengths. One of the common conductors can be selectively connected in and out with respect to radio frequency signals in order to adjust the total electrical length of the antenna device, thereby making it operable in four different frequency bands.

19 Claims, 3 Drawing Sheets

OTHER PUBLICATIONS

European Search Report from European application No. 06445028.1 (the Euopean application that the published application WO 2007/136330 A2 claims priority to; dated Nov. 10, 2006, 6 pages.

First Office Action from European application No. 06445028.1; dated Jun. 23, 2008, 1 page.

Second Office Action from European application No. 06445028.1, dated Apr. 8, 2009, 6 pages.

Third Office Action from European application No. 06445028.1, dated Apr. 15, 2010, 15 pages.

* cited by examiner

ANTENNA DEVICE AND PORTABLE RADIO COMMUNICATION DEVICE COMPRISING SUCH AN ANTENNA DEVICE

CROSS REFERENCE TO RELATED APPLICATIONS

This patent application is a U.S. national stage filing under 35 U.S.C. §371 of International Application No. PCT/SE2007/000492 filed May 18, 2007, which claims priority of European patent application No. EP06445028.1 filed May 19, 2006.

FIELD OF INVENTION

The present invention relates generally to antenna devices and more particularly to a controllable internal multi-band antenna device for use in portable radio communication devices, such as in mobile phones. The invention also relates to a portable radio communication device comprising such an antenna device.

BACKGROUND

Internal antennas have been used for some time in portable radio communication devices. There are a number of advantages connected with using internal antennas, of which can be mentioned that they are small and light, making them suitable for applications wherein size and weight are of importance, such as in mobile phones. A type of internal antenna that is often used in portable radio communication devices is the monopole antenna.

However, the monopole antenna is inherently resonant in one frequency band. If multi-band operation is required, wherein the antenna is adapted to operate in two or more spaced apart frequency bands, two monopole antennas with different resonance frequencies can be provided. In a typical dual band phone, the lower frequency band is centered on 900 MHz, the so-called GSM 900 band, whereas the upper frequency band is centered around 1800 or 1900 MHz, the DCS and PCS band, respectively. If the upper frequency band of the antenna device is made wide enough, covering both the 1800 and 1900 MHz bands, a phone operating in three different standard bands is obtained. However, with today's high demands on functionality, antenna devices operating four or even more different frequency bands are in demand. With the limitations regarding cost and size of antenna devices this quad band operation is difficult to achieve.

A problem in prior art antenna devices is thus to provide a multi-band antenna with a small size and volume and broad frequency bands which retains good performance.

SUMMARY OF THE INVENTION

An object of the present invention is to provide an antenna device of the kind initially mentioned wherein the frequency characteristics provides for four comparatively wide frequency bands while the overall size of the antenna device is small.

Another object is to provide an antenna device having better multi-band performance than prior art devices.

The invention is based on the realization that several frequency bands can be provided in an antenna device by arranging the antenna with two branches of different lengths and a switch arrangement adjusting the electrical lengths of the branches to provide four different resonance frequencies.

According to a first aspect of the present invention there is provided an antenna device as defined in claim 1.

According to a second aspect of the present invention there is provided portable radio communication device as defined in claim 10.

Further preferred embodiments are defined in the dependent claims.

The invention provides an antenna device and a portable radio communication device wherein the problems in prior art devices are avoided or at least mitigated by means of providing a switch. Thus, there is provided a small sized low cost multi-band antenna device operable in at least four different frequency bands.

The switch is preferably a PIN diode, having good properties when operating as an electrically controlled RF switch.

BRIEF DESCRIPTION OF DRAWINGS

The invention is now described, by way of example, with reference to the accompanying drawings, in which.

DETAILED DESCRIPTION OF THE INVENTION

In the following, a detailed description of preferred embodiments of an antenna device according to the invention will be given. In the description, for purposes of explanation and not limitation, specific details are set forth, such as particular hardware, applications, techniques etc. in order to provide a thorough understanding of the present invention. However, it will be apparent to one skilled in the art that the present invention may be utilized in other embodiments that depart from these specific details. In other instances, detailed descriptions of well-known methods, apparatuses, and circuits are omitted so as not to obscure the description of the present invention with unnecessary details.

Figure 1:
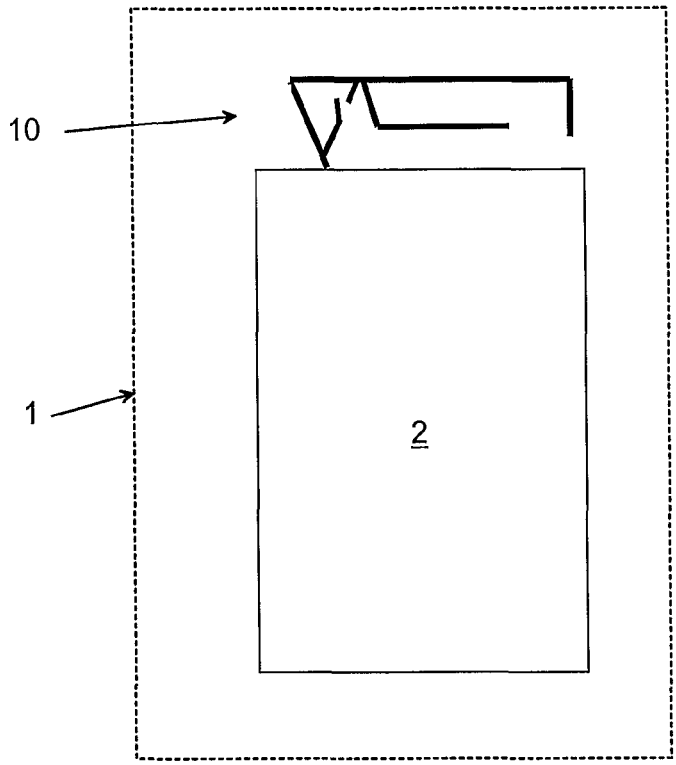
FIG. 1 is an overall view of a portable radio communication device comprising an antenna device according to the invention.

FIG. 1 shows the outlines of a portable radio communication device 1, such as a mobile phone. An antenna device 10 is arranged at the top of the communication device, adjacent to a printed circuit board (PCB) 2, and being connected to RF feeding and grounding devices (not shown).

Figure 2:
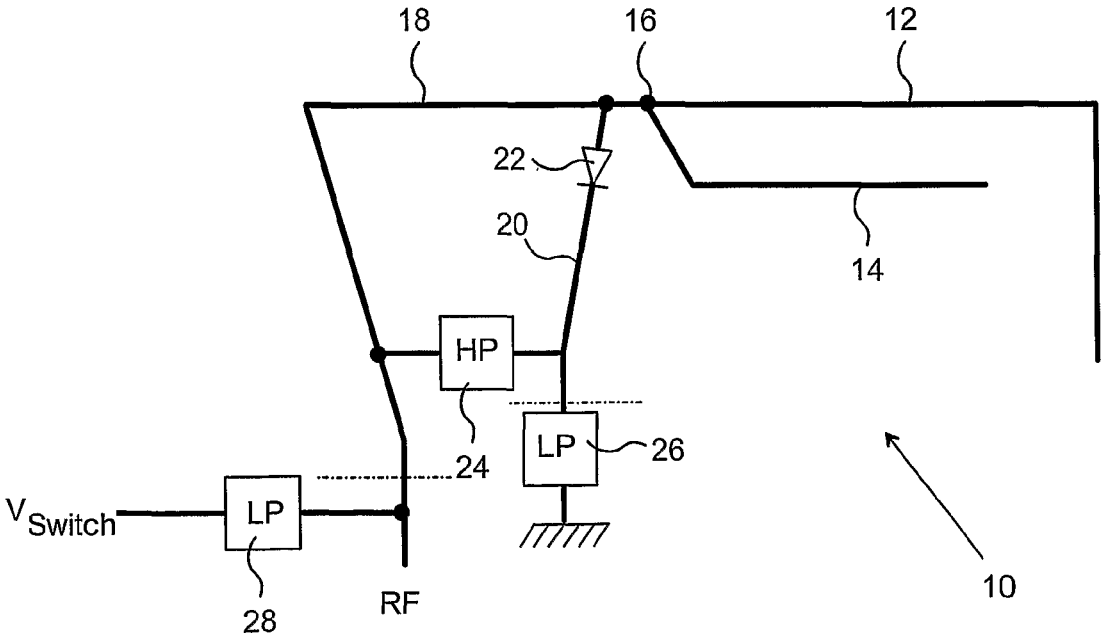
FIG. 2 shows a schematic diagram of a first embodiment of an antenna device according to the invention.

In FIG. 2, there is shown the antenna device 10 comprising a first elongated monopole radiating element 12 made of an electrically conductive material, such as a flex film, as is conventional. A second elongated monopole radiating element 14 is provided in parallel with the first radiating element.

The first and second radiating elements 12, 14 are connected to a first common elongated conductor 18 at a junction point 16. The first common conductor is in turn connected to a source of radio frequency signals RF, such as RF circuitry in the portable radio communication device 1 shown in FIG. 1.

The first common conductor 18 and the first radiating element 12, which are connected in series, are together arranged to resonate in a first lower frequency band LB1, such as the GSM 850 band. Correspondingly, the first common conductor 18 and the second radiating element 14 are together arranged to resonate in a first higher frequency band HB1, such as the GSM 1800 band.

Thus, the combination of the two branches 12, 14 and the common conductor 18 operates as a dual-band antenna device.

A second common conductor 20 is connected in parallel with the first common conductor, the second common conductor being electrically shorter than the first common conductor. A switch element 22 is provided in series with this second common conductor, preferably close to the common junction point 16. This switch element is preferably a PIN diode, i.e., a silicon junction diode having a lightly doped intrinsic layer serving as a dielectric barrier between p and n layers. Ideally, a PIN diode switch is characterized as an open circuit with infinite isolation in open mode and as a short circuit without resistive losses in closed mode, making it suitable as an electronic switch. In reality the PIN diode switch is not ideal. In open mode the PIN diode switch has capacitive characteristic (0.1-0.4 pF), which results in finite isolation (15-25 dB @ 1 GHz) and in closed mode the switch has resistive characteristic (0.5-3 ohm) which results in resistive losses (0.05-0.2 dB).

A high pass filter 24 is also provided in series with this second common conductor, the function of which will be explained below. Finally the second common conductor 20 is connected to ground via a low pass filter 26 arranged to block all radio frequency signals. The low pass filter 26 can be arranged either in the antenna device itself or in electronic circuitry arranged on the PCB 2.

Finally, a DC control input, designated $V_{Switch}$ in the figures, for controlling the operation of the PIN diode 22 is connected to the RF input via a filter block 28 to not affect the RF characteristics of the antenna device. This means that the filter characteristics of the filter block 28 is designed so as to block all radio frequency signals. In the preferred embodiment, the filter block 28 comprises a low pass filter.

It is preferred that the interface to the antenna device is provided as indicated by the dash-dotted lines in the figures. This means that the filter block 28 is arranged in electronic circuitry arranged on the PCB 2 and that the signal provided to the antenna device is an RF signal being DC biased or not DC biased, depending on mode of operation, as will be explained below.

The antenna is preferably designed to 50 Ohms.

The switching of the antenna device functions as follows. The RF source and other electronic circuits of the communication device operate at a given voltage level, such as 1.5 Volts. The criterion is that the voltage level is high enough to create the necessary voltage drop across the PIN diode, i.e. about 1 Volt. This means that the control voltage $V_{Switch}$ is switched between the two voltages "high" and "low", such as 1.5 and 0 Volts, respectively. When $V_{Switch}$ is high, there is a DC current flowing from the DC control input, through the low pass filter 28, via the first common conductor 18, through the PIN diode 22 and part of the second common conductor 20, and finally through the low pass filter 26 and to ground. This DC current creates a voltage drop across the PIN diode 22 and a corresponding current there through of about 5-15 mA. This voltage drop makes the diode conductive, effectively making the second common conductor 20 conductive with respect to RF signals. With the control voltage $V_{Switch}$ "low", there is an insufficient voltage drop across the PIN diode 22 to make it conductive, i.e., it is "open", effectively blocking any RF signals in the second common conductor 20.

With the switch closed, the electrical length of the second common conductor 20, which is shorter than the first common conductor 18, will determine the total electrical length of the antenna device. Thus, the second common conductor 20 and the first radiating element 12, which are connected in series, are together arranged to resonate in a second lower frequency band LB2, such as the GSM 900 band. Correspondingly, the second common conductor 20 and the second radiating element 14 are together arranged to resonate in a second higher frequency band HB2, such as the GSM 1900 band.

In summary, the size and configuration of the two elongated radiating elements 12, 14 and the two common conductors 18, 20 are chosen so as to obtain the desired resonance frequencies, such as the 850 and 1800 MHz bands with the switch open and the 900 and 1900 MHz bands with the switch closed.

Figure 3:
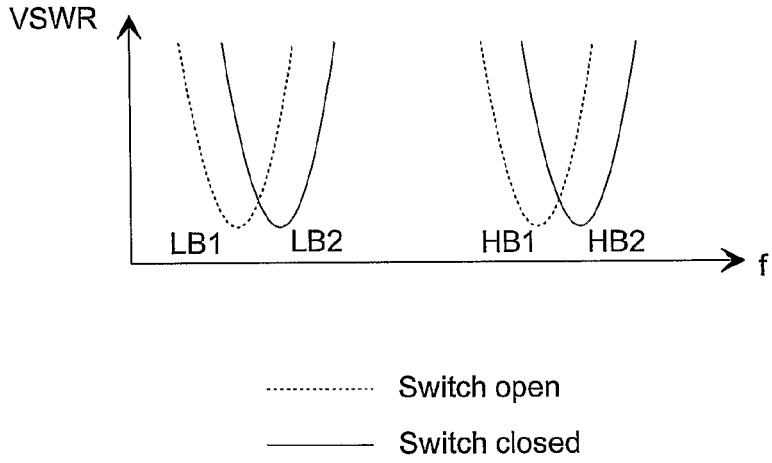
FIG. 3 is a frequency diagram of the operating modes of the antenna shown in FIG. 2.

This change of geometry of the effective radiating elements adjusts the resonance frequencies of antenna device. This is seen in FIG. 3, wherein the dashed curves correspond to the operating mode with the switch open, i.e., with $V_{Switch}$ low, and the solid curves correspond to the operating mode with the switch closed, i.e., with $V_{Switch}$ high. The means that an antenna device which can operate in four different frequency bands is obtained, such as the above mentioned 850/900/1800/1900 MHz bands.

The adjustment of the resonance frequencies shown in FIG. 3 can be used to an advantage in so-called fold phones. In these kind of communication devices, the resonance frequency of an internal antenna element tends to move downwards in frequency when the position of the phone is changed from folded to unfolded mode. With the inventive antenna device, when the phone is unfolded, the movement of the resonance frequencies can be counteracted by closing the switch 22. Thus, with the phone folded, the control voltage V.sub.switch2 is low and with the phone unfolded, the control voltage is high. The antenna device then operates as a dual band antenna with essentially constant resonance frequency irrespective of the operating mode of the communication device (folded/unfolded).

The adjustment of the resonance frequencies shown in FIG. 3 can also be used to an advantage in dual band bar phones. In the frequency bands used for mobile communication, the transmit (TX) and receive (RX) frequencies are separated by approximately 45-90 MHz. By using frequency adjustment, near optimum efficiency can be obtained by adjusting the frequencies to the TX and RX frequencies instead of the broader frequency band incorporating the TX and RX frequencies.

Figure 4:
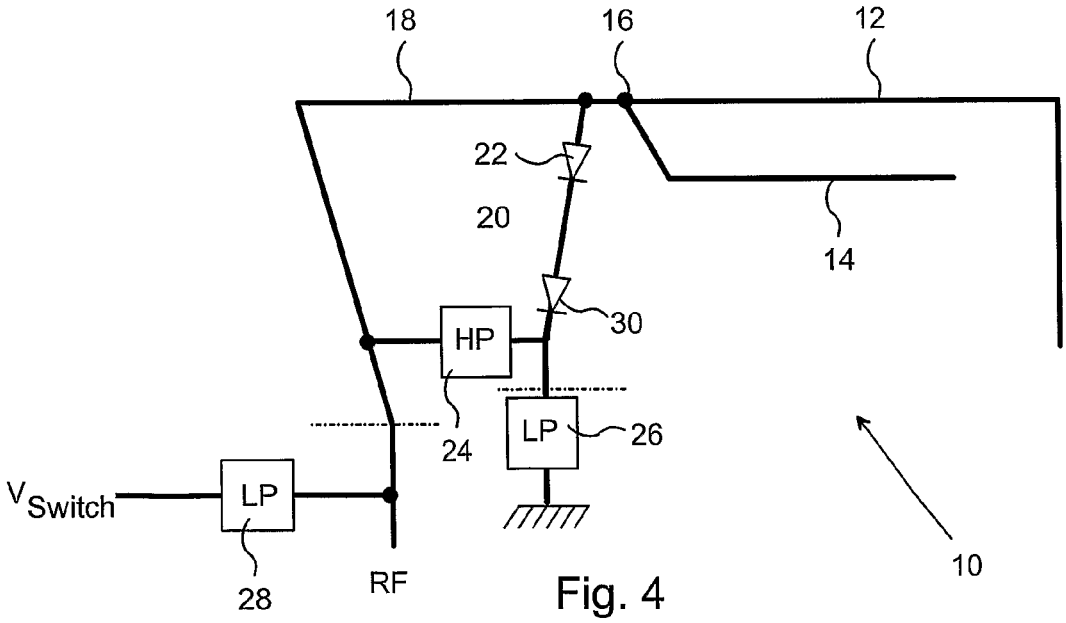
FIG. 4 shows a schematic diagram of a second embodiment of an antenna device according to the invention.

In FIG. 4 a second embodiment of an antenna device according to the invention is shown. This is in most aspects identical to the one described with reference to FIG. 2. However, there is a second switch element 30 in the form of an additional PIN diode provided between the high pass filter 24 and the first common conductor 18 at an end of the second common conductor opposite to where the first switch element 22 is provided. This improves the decoupling of the second common conductor 20 when operating with the switches open.

Figure 5:
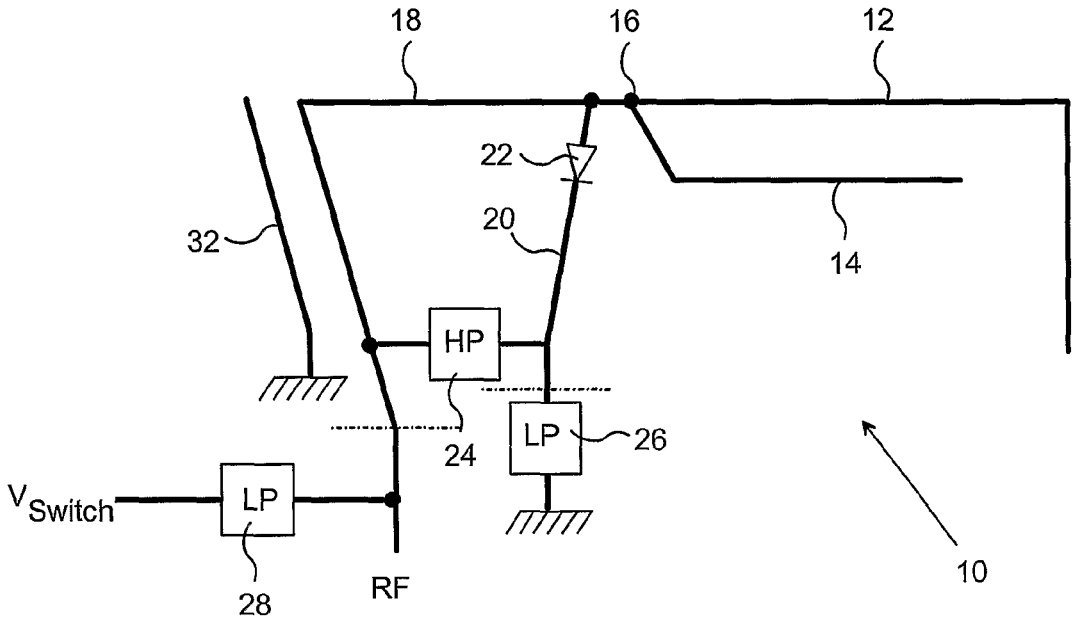
FIG. 5 shows a schematic diagram of a third embodiment of an antenna device according to the invention including a parasitic element.

In FIG. 5 a third embodiment of an antenna device according to the invention is shown. This is in most aspects identical to the one described with reference to FIG. 2. However, there is a conductive elongated parasitic element 32 provided close to the first common conductor 18. This parasitic element, which is grounded in one end, provides a fifth frequency band of the antenna device, such as the Bluetooth frequency band operating around 2.4 GHz or around 3 GHz (WCDMA).

Figure 6:
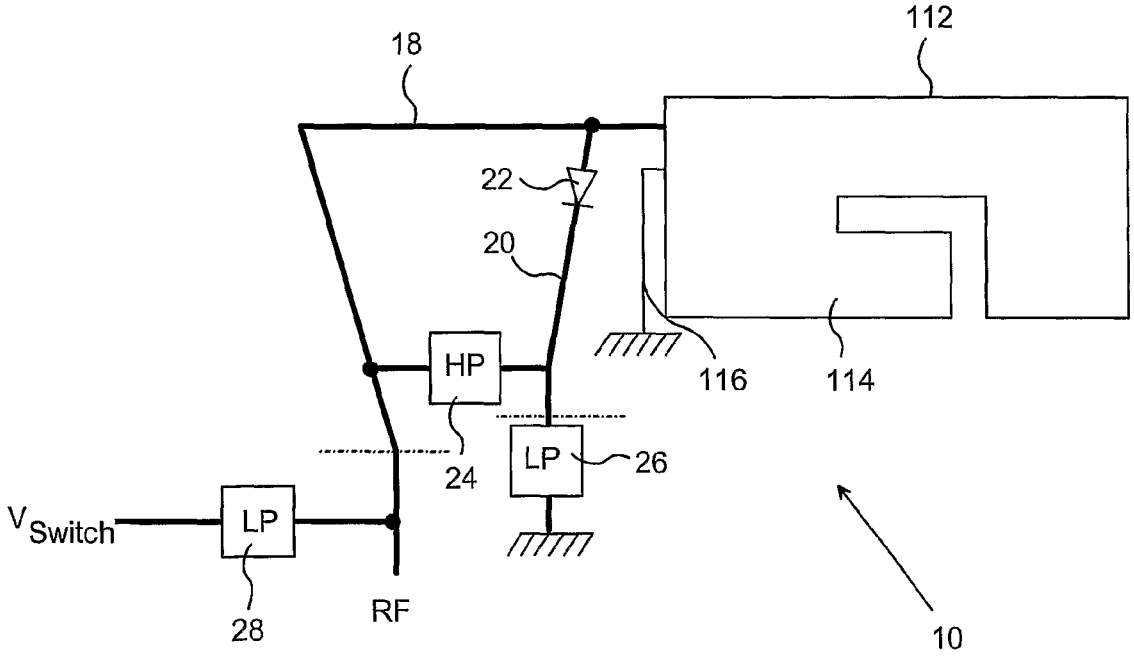
FIG. 6 shows a schematic diagram of a fourth embodiment of an antenna device according to the invention comprising a PIFA.

In FIG. 6 a fourth embodiment of an antenna device according to the invention is shown. It uses the above described general concept of adjusting the length of the radiating element by switching in and out two parallel conductors of different lengths but in this case applied to a so-called planar inverted F antenna (PIFA). The PIFA comprises a generally planar conductive plate divided by a slot into a first branch 112 and a second branch 114. The first branch 112, functionally corresponding to the first radiating element 12 described above is longer than the second branch which functionally correspond to the above described second radiating element 114. There is also a grounding connection 116 provided between the conductive plate and ground.

The switching concept applied on monopole antennas is the same for this PIFA, thereby creating an antenna device operable in four different frequency bands.

Preferred embodiments of an antenna device according to the invention have been described. However, it will be appreciated that these can be varied within the scope of the appended claims. Thus, a PIN diode has been described as the switch element. It will be appreciated that other kinds of switch elements can be used as well, such as GaAs switches, most conveniently single pole, dual throw (SPDT) switches, or transistor switches.

Although a PIFA has been shown in FIG. 6, it will be appreciated that the inventive idea is applicable also on so-called inverted F antennas (IFAs).

The invention claimed is:

1. An antenna device for a portable radio communication device operable in at least four different frequency bands, the antenna device comprising:

a first electrically conductive radiating element;

a second electrically conductive radiating element;

a junction point connecting the first and second electrically conductive radiating elements;

a first conductor arranged between the junction point and a source of RF signals; a second conductor arranged between the junction point and the source of RF signals, wherein the second conductor has an electric length that is shorter than an electric length of the first conductor;

a controllable switch element provided in series with the second conductor, said controllable switch element being controllable by a current flowing through the controllable switch element;

a first filter block provided in series with the second conductor, between the first conductor and the second conductor wherein a common junction between the first conductor and the first filter block is connected to the source of RF signal; said first filter block being arranged to block signals with a frequency lower than the at least four different frequency bands;

the first conductor and the first radiating element are connected in series and are together arranged to resonate in a first lower frequency band with the controllable switch element opened;

the first conductor and the second radiating element are together arranged to resonate in a first higher frequency band with the controllable switch element opened;

the second conductor and the first radiating element are connected in series and are together arranged to resonate in a second lower frequency band with the controllable switch element closed, the second lower frequency band being higher than the first lower frequency band; and the second conductor and the second radiating element are together arranged to resonate in a second higher frequency band with the controllable switch element closed, the second higher frequency band being higher than the first higher frequency band.

2. The antenna device according to claim 1, comprising a second filter block arranged between the second conductor and ground, wherein the second filter is arranged to block signals in the at least four different frequency bands.

3. The antenna device according to claim 1, comprising a third filter block arranged between the first conductor and a control voltage input ($V_{switch}$).

4. The antenna device according to claim 1, wherein the controllable switch element comprises a PIN diode.

5. The antenna device according to claim 4, wherein:

a control voltage input ($V_{switch}$) for controlling operation of the PIN diode is connected to the source of RF signals via a filter block;

the control voltage input ($V_{switch}$) is switchable between at least:

a low voltage in which there is an insufficient voltage drop across the PIN diode to make the PIN diode conductive such that the PIN diode is open and effectively blocks RF signals in second conductor; and a high voltage in which a voltage drop across the PIN diode makes the PIN diode conductive and the second conductor is conductive with respect to RF signals.

6. The antenna device according to claim 5, wherein the antenna device is configured such that when the control voltage input ($V_{switch}$) is at the high voltage, a current flows from the control voltage input ($V_{switch}$), through the filter block, through the first conductor, and through the PIN diode, which current through the PIN diode is between about 5 to 15 milliamps.

7. The antenna device according to claim 1, wherein the controllable switch element comprises a GaAs switch.

8. The antenna device according to claim 1, wherein the first and second radiating elements are elongated monopole radiating elements.

9. The antenna device according to claim 1, wherein the first and second radiating elements are parts of planar inverted F antenna.

10. The antenna device according to claim 1, comprising a further controllable switch element provided between the first filter block and the first conductor at an end of the second conductor opposite to where the controllable switch element is provided, whereby the further controllable switch element is operable for improving decoupling of the second conductor when the controllable switch elements are open.

11. The antenna device according to claim 1, comprising a conductive elongated parasitic element provided close to the first conductor, whereby the parasitic element, which is grounded in one end, provides a fifth frequency band such that the antenna device is operable in at least five different frequency bands.

12. The antenna device according to claim 11, wherein the antenna device is operable in at least five different frequency bands, including the GSM 850 band, the GSM 900 band, the GSM 1800 band, the GSM 1900 band, and the Bluetooth frequency band operating around 2.4 GHz or around 3 GHz (WCDMA).

13. The antenna device according to claim 1, wherein the antenna device is configured such that when the controllable switch element is switched on:

the second conductor will determine the electrical length of the antenna device; and the second conductor is arranged to resonate in one frequency band together with the first radiating element and to resonate in another higher frequency band together with the second radiating element.

14. The antenna device of claim 1, wherein:

the first conductor is connected between the junction point and the source of RF signals;

the second conductor is connected in parallel with the first conductor between the junction point and the source of RF signals.

15. The antenna device of claim 1, comprising:

a further controllable switch element provided between the first filter block and the first conductor at an end of the second conductor opposite to where the controllable switch element is provided; and a conductive elongated parasitic element provided close to the first conductor.

16. The antenna device according to claim 1, wherein:

the first lower frequency band is the 850 MHz band;

the second lower frequency band is the 900 MHz band;

the first higher frequency band is the 1800 MHz band; and the second higher frequency band is the 1900 MHz band.

17. A portable radio communication device comprising an antenna device operable in at least four different frequency bands, the antenna device comprising:

a first electrically conductive radiating element;

a second electrically conductive radiating element;

a junction point connecting the first and second electrically conductive radiating elements;

a first conductor arranged between the junction point and a source of RF signals; a second conductor arranged between the junction point and the source of RF signals, wherein the second conductor has an electric length that is shorter than an electric length of the first conductor;

a controllable switch element provided in series with the second conductor, said controllable switch element being controllable by a current flowing through the controllable switch element;

a first filter block provided in series with the second conductor, between the first conductor and the second conductor wherein a common junction between the first conductor and the first filter is connected to the source of RF signal; said first filter block being arranged to block signals with a frequency lower than the at least four different frequency bands;

a second filter block arranged between the second conductor and ground, wherein the first filter is arranged to block signals in the at least four different frequency bands;

a third filter block arranged between the first conductor and a control voltage input (V switch);

the first conductor and the first radiating element are connected in series and are together arranged to resonate in a first lower frequency band with the controllable switch element opened;

the first conductor and the second radiating element are together arranged to resonate in a first higher frequency band with the controllable switch element opened;

the second conductor and the first radiating element are connected in series and are together arranged to resonate in a second lower frequency band with the controllable switch element closed, the second lower frequency band being higher than the first lower frequency band; and the second conductor and the second radiating element are together arranged to resonate in a second higher frequency band with the controllable switch element closed, the second higher frequency band being higher than the first higher frequency band.

18. The portable radio communication device of claim 17, wherein the portable radio communication device comprises a fold phone configured such that:

the controllable switch element is closed for counteracting downward movement of resonance frequencies when the fold phone is unfolded; and the controllable switch element is open when the fold phone is folded;

whereby the antenna device is operable with essentially constant resonance frequency irrespective of the folded or unfolded mode of the folded phone.

19. An antenna device for a portable radio communication device operable in at least five different frequency bands, the antenna device comprising:

a first electrically conductive radiating element;

a second electrically conductive radiating element;

a junction connecting the first and second radiating elements;

a first conductor connected between the junction point and a source of RF signals;

a second conductor connected in parallel with the first conductor between the junction point and the source of RF signals, wherein the second conductor has an electric length that is shorter than the electric length of the first conductor;

a first controllable switch element provided in series with the second conductor, said controllable switch element being controllable by a current flowing through the controllable switch element;

a first filter block provided in series with the second conductor, between the first conductor and the second conductor wherein a common junction between the first conductor and the first filter is connected to the source of RF signal; said first filter block being arranged to block signals with a frequency lower than the at least four different frequency bands;

a second controllable switch element provided between the first filter block and the first conductor at an end of the second conductor opposite to where the first controllable switch element is provided; and a conductive elongated parasitic element provided close to the first conductor;

wherein the first conductor and the first radiating element are connected in series and are together arranged to resonate in a first lower frequency band with the first and second controllable switch elements opened;

the first conductor and the second radiating element are together arranged to resonate in a first higher frequency band with the first controllable switch element opened;

the second conductor and the first radiating element are connected in series and are together arranged to resonate in a second lower frequency band with the first controllable switch element closed, the second lower frequency band being higher than the first lower frequency band; and the second conductor and the second radiating element are together arranged to resonate in a second higher frequency band with the first controllable switch element closed, the second higher frequency band being higher than the first higher frequency band;

whereby the second controllable switch element is operable for improving decoupling of the second conductor when the controllable switch elements are open; and the parasitic element provides a fifth frequency band such that the antenna device is operable in at least five different frequency bands.

* * * * *